US007976946B2

(12) United States Patent
Tisseyre et al.

(10) Patent No.: US 7,976,946 B2
(45) Date of Patent: Jul. 12, 2011

(54) SOUND-ABSORBING FABRIC

(75) Inventors: Alain Tisseyre, Toulouse (FR); Didier Mouraret, Lyons (FR)

(73) Assignee: Acoustic Fabric (FR)

( * ) Notice: Subject to any disclaimer, the term of this patent is extended or adjusted under 35 U.S.C. 154(b) by 0 days.

(21) Appl. No.: 11/575,810

(22) PCT Filed: Sep. 23, 2005

(86) PCT No.: PCT/FR2005/002364

§ 371 (c)(1),
(2), (4) Date: Jun. 22, 2007

(87) PCT Pub. No.: WO2006/035145

PCT Pub. Date: Apr. 6, 2006

(65) Prior Publication Data

US 2007/0287346 A1 Dec. 13, 2007

(30) Foreign Application Priority Data

Sep. 24, 2004 (FR) ..... 04 10139

(51) Int. Cl.
*D02G 3/00* (2006.01)

(52) U.S. Cl. ..... 428/378; 442/20; 442/43; 442/54; 442/58; 442/217; 442/218; 442/219; 442/301; 428/364; 428/365; 428/375; 427/212

(58) Field of Classification Search ..... 442/20, 442/43, 54, 58, 217–219, 301; 428/364, 428/365, 375, 378; 427/212
See application file for complete search history.

(56) References Cited

U.S. PATENT DOCUMENTS

| | | | | | |
|---|---|---|---|---|---|
| 4,774,135 | A | * | 9/1988 | Bryant | 428/392 |
| 4,994,317 | A | * | 2/1991 | Dugan et al. | 442/72 |
| 5,681,408 | A | * | 10/1997 | Pate et al. | 156/71 |
| 5,763,043 | A | * | 6/1998 | Porter et al. | 428/109 |
| 6,059,655 | A | | 5/2000 | Koerber | |
| 2005/0159058 | A1 | * | 7/2005 | Christou et al. | 442/44 |

FOREIGN PATENT DOCUMENTS

| | | |
|---|---|---|
| FR | 2329613 | 5/1977 |
| FR | 2619399 | 2/1989 |
| FR | 0315269 | * 12/2003 |

OTHER PUBLICATIONS

International Search Report; PCT/FR2005/002364; Mar. 14, 2006.

* cited by examiner

*Primary Examiner* — Norca L Torres-Velazquez
(74) *Attorney, Agent, or Firm* — Cantor Colburn LLP

(57) ABSTRACT

The invention relates to a sound-absorbing fabric comprising a glass fabric which is made from glass yarns that are coated with a thermoplastic material, with an opening factor of between 0.5 and 6%.

8 Claims, No Drawings

SOUND-ABSORBING FABRIC

BACKGROUND OF THE INVENTION

The subject of the present invention is a sound-absorbing fabric.

DESCRIPTION OF THE PRIOR ART

Using sound-absorbing components is known in a certain number of applications, especially that target the construction of buildings or that target the construction of road foundations. These sound-absorbing components are often formed from mineral wool or absorbent foam panels, positioned behind structural panels, such as metal ceiling tiles, structures made from wood or polyvinyl chloride, or perforated polyvinyl chloride membranes. These panels made from an absorbent material may also be placed behind panels for screening roads.

In any case, the mineral wood panels have drawbacks in terms of safety, insofar as they may result in a significant release of fibers. Moreover, these panels made from mineral wool or from absorbent foam are bulky, and may absorb moisture when they are used in an outside environment. Finally these components do not have an attractive appearance, so that it is advisable to use them behind a covering support.

SUMMARY OF THE INVENTION

The invention provides a sound-absorbing component, which is of simple structure, quick implementation, which is attractive, which has all the safety guarantees, and which may be stored and used while only taking up a small amount of space.

To that effect, the invention relates to a sound-absorbing fabric, formed from a glass fabric produced from glass yarns coated with a thermoplastic, having an aperture ratio between 0.5 and 6%.

Advantageously, the size and shape of the holes are determined in order to obtain a Sabine sound absorption coefficient $\alpha_w$, with a 10 cm plenum, between 0.3 and 0.8 depending on the sound frequency.

This shape and the aperture ratio of the holes may be obtained directly at the end of the weaving. The fabric is advantageously subjected to a heat treatment, without stress, which enables the yarns to be locked in. It is also possible to use a calendering operation, for a fabric with a lighter aperture ratio, in order to reduce the aperture ratio to the desired value.

The reduction of the aperture ratio may also be obtained by subjecting at least one of the faces of the fabric to coating with a transparent or colored binder.

According to another feature of the invention, the diameter of the glass yarns is between 150 and 600 microns and preferably between 270 and 400 microns.

Moreover, the linear density of the glass yarns alone is between 22 and 136 tex, preferably between 34 and 68 tex, and the linear density of the yarns coated with a thermoplastic is between 60 and 200 tex and preferably between 95 and 165 tex.

DESCRIPTION OF THE PREFERRED EMBODIMENTS

Given below are two examples of sound-absorbing fabric, obtained from glass yarns having the preceding features.

EXAMPLE 1

| | |
|---|---|
| Composition: | 36% glass and 64% PVC (polyvinyl chloride) + coating or calendering |
| Density: | 22 × 20 yarns/cm |
| Pattern: | 1 × 2 plain weave |
| Thickness: | 0.55 mm |
| Tensile strength: | warp direction > 150 daN/5 cm<br>weft direction > 150 daN/5 cm |
| Aperture ratio: | 1 to 2% |
| Fire rating: | M1 |
| Sabine coefficient $\alpha_w$: | 0.6 |

EXAMPLE 2

| | |
|---|---|
| Composition: | 36% glass and 64% PVC |
| Density: | 26 × 21 yarns/cm |
| Pattern: | 1 × 2 plain weave |
| Thickness: | 0.55 mm |
| Tensile strength: | warp direction > 150 daN/5 cm<br>weft direction > 150 daN/5 cm |
| Aperture ratio: | 1 to 2% |
| Fire rating: | M1 |
| Sabine coefficient $\alpha_w$: | 0.6 |

This fabric may especially be used in the following situations:

- instead of mineral wool or sound-absorbing foam panels positioned behind structural panels, such as metal ceiling tiles, structures made of wood or polyvinyl chloride, or perforated polyvinyl chloride or membrane cloth;
- as a replacement for absorbent products behind panels for screening roads;
- in the form of cloth stretched over a metal structure, or over cables; or else
- laminated over a carrier structure, such as a cellular structure.

As a result of what has been mentioned so far, the invention brings a great improvement to the existing art, by providing a sound-absorbing component, of simple structure, which may be used directly and not behind a decorative facade, since the absorbing fabric itself has decorative properties, which is of low weight and low volume, and which has all the safety and reliability conditions, considering the lack of degradation over time, even if the fabric is subjected to bad weather.

It goes without saying that the invention is not limited to only the embodiments of this fabric described above by way of examples, but, on the contrary, it encompasses all the embodiment variations thereof that remain within the scope of the claims.

What is claimed is:

1. A sound-absorbing fabric consisting of:

a glass fabric including a plurality of glass yarns coated with a coating, said glass fabric having an aperture ratio between 0.5 and 2%, wherein an entirety of said coating on said plurality of glass yarns consists of a thermoplastic coating that is individually applied to each of said glass yarns prior to a weaving of said glass yarns into said glass fabric.

2. The fabric as claimed in claim 1, wherein the size and shape of the holes are determined in order to obtain a Sabine sound absorption coefficient $\alpha_w$, with a 10 cm plenum, between 0.3 and 0.8 depending on the sound frequency.

3. The fabric as claimed in claim 1, wherein the fabric is subjected to a heat treatment, without stress.

4. A method for weaving a sound-absorbing fabric, the method comprising comprising:

individually coating each of a plurality of glass yarns with a thermoplastic coating;

weaving said glass yarns into a glass fabric after said individual coating of each of said plurality of glass yarns; and providing an aperture ratio between 0.5 and 6%, in said glass fabric via said weaving.

5. The fabric as claimed in claim 1, wherein the glass fabric includes a density of 26×21 yarns/cm.

6. The fabric as claimed in claim 1, wherein the diameter of the glass yarns is between about 150 and 600 microns.

7. The fabric as claimed in claim 1, wherein the linear density of the glass yarns alone is between 22 and 136 tex and the linear density of the yarns coated with the thermoplastic coating is between 60 and 200 tex.

8. The fabric as claimed in claim 1, wherein the glass yarns are inclusive of warp yarns and filling yarns, a number of the warp yarns in the glass fabric being greater than a number of the filling yarns.

* * * * *